United States Patent [19]

Molitor

[11] Patent Number: 4,812,136

[45] Date of Patent: Mar. 14, 1989

[54] ELECTRICAL PLUG AND SOCKET CONNECTOR

[75] Inventor: Paul-Rainer Molitor, Mühldorf/Inn, Fed. Rep. of Germany

[73] Assignee: Otto Dunkel GmbH, Fabrik fur Eletrotechnische Gerate, Mühldorf, Fed. Rep. of Germany

[21] Appl. No.: 184,890

[22] Filed: Apr. 22, 1988

[30] Foreign Application Priority Data

Apr. 30, 1987 [DE] Fed. Rep. of Germany ..... 3714552

[51] Int. Cl.[4] ..... H01R 13/40

[52] U.S. Cl. ..... 439/589; 439/598

[58] Field of Search ..... 439/275, 279, 281, 592–594, 439/589, 598, 603

[56] References Cited

U.S. PATENT DOCUMENTS

| | | | |
|---|---|---|---|
| 2,881,406 | 4/1959 | Arson | 439/589 |
| 3,101,226 | 8/1963 | Yopp | 439/598 |
| 3,631,375 | 12/1971 | Bridle | 439/589 |
| 3,816,641 | 7/1974 | Iversen | 174/76 |
| 4,355,855 | 10/1982 | Rebikoff | 399/94 A |

FOREIGN PATENT DOCUMENTS

| | | |
|---|---|---|
| 725021 | 3/1955 | United Kingdom . |
| 1116143 | 6/1968 | United Kingdom . |

OTHER PUBLICATIONS

Allied Amphenol Products, "482 GB Series CE-27 Circular Environmental Connector", product description, pp. 1–2.

*Primary Examiner*—Paula A. A. Bradley

*Attorney, Agent, or Firm*—Holman & Stern

[57] ABSTRACT

An electrical plug and socket connector includes a two-part connector frame (1) which can be affixed to an apparatus housing, and further includes a two-piece insulating body (4, 5) enclosed between the two frame parts (2, 3), which insulating body has a plurality of bores to accommodate contact elements (6, 7) in the form of plug pins, plug sockets, or the like, which contact elements are connectable to electrical conductors on the rear side of the connector. The insulating body includes a frontwardly disposed supporting and guiding plate (4) fabricated of thermoplastic plastic. The insulating body also includes a rear plate (5). In order to achieve a trouble-free seal, the rear plate of the insulating body is in the form of a sealing plate (5) of rubberlike elastic material, and this sealing plate (5) is particularly dimensioned with respect to the supporting and guiding plate (4), which supporting and guiding plate rests against the outwardly curved or flared flange (12) of the front part of the frame. Namely, the sealing plate (5) is so dimensioned with respect to the face of the supporting and guiding plate (4) which is directed toward it, that after the two frame parts (2, 3) are fastened together the edge region (13) of the sealing plate is held in compression against a supporting edge region (14) of the rear frame part (3), whereby a trouble-free seal is created.

3 Claims, 1 Drawing Sheet

ELECTRICAL PLUG AND SOCKET CONNECTOR

BACKGROUND AND SUMMARY OF THE INVENTION

The invention relates to an electrical plug and socket connector having an elongated metal connector frame (shell) which can be affixed to an apparatus housing or the like.

The connector frame consists of a frame front part and a frame rear part. The plug and socket connector further includes a two-piece insulating body fabricated of insulating materials and enclosed between the two frame parts, the insulating body having a plurality of bores to accommodate therein a plurality of contact elements in the form of plug pins, plug sockets, or the like which elements become enclosed in and insulated by the insulating materials of t he insulating body. These contact elements are connectable to electrical conductors on the rear side of the connector, and at the front side of the connector they can be engaged with mating contact elements which are assembled into a corresponding multiconductor (i.e., "multipole") socket or plug member and which are connected to a connecting cable.

Further, the insulating body includes a front supporting and guiding plate fabricated of thermoplastic plastic which plate has bores to accommodate the front ends (i.e.. frontward regions) of the contact elements.

The insulating body also includes a rear plate with corresponding bores for the rear ends (i.e., rearward regions) of the contact elements.

Plug and socket connectors of this type have been widely adopted in practice. They are referred to as "D-sub" type connectors. Standards for their dimensions and pole configurations are presented in, e.g., DIN 41652, MS 18274, and MS 18276. This type of plug is in Protective Class IP 54 or better, according to DIN 40050. In known D-sub connectors with two-piece insulating bodies, not only the front plate but also the rear plate of the insulating body is fabricated of thermoplastic plastic and is configured such that contact elements can be mechanically mounted therein for crimp connection of conductors to the contact elements.

It has been found that for all plug and socket connections of this type, sealing against dust and water cannot be achieved without additional measures, e.g. adhesive bonding of the contact elements and appropriate sealing of the pieces of the insulating body into the metal connector frame with the aid of elastic sealing compounds. These measures are inconvenient, time-consuming, and costly. Further, when such measures are employed in serial production they do not ensure reproducible seal conditions (i.e., seal quality), thereby necessitating costly testing and other quality assurance procedures. They have the further disadvantage that when adhesive bonding is employed it results in rigid fixing of the positions of the contact elements in the insulating body, whereby the only options for connecting cables to the connector members are in situ soldering techniques. Moreover, additional measures are required in cabling (i.e., manufacturing of connector cables), on account of the need to adjust to slight dimensional variations; and these raise manufacturing costs.

An underlying object of the present invention is to improve the electrical plug and socket connector of the type described above, such that it is sealed against water and dust, by relatively simple fabricating techniques, and so that the front ends of the contact elements are still movable to a small degree so as to adjust to slight dimensional differences, and further, so that, even after the cable has been attached to the contact elements, the contact elements can be pushed into the bores of the insulating body and affixed therein Without degrading the seal.

This problem is solved by the present inventive plug and socket connector which is distinguished essentially in that the rear plate of the insulating body is in the form of a sealing plate of rubberlike elastic material, and this sealing plate is particularly dimensioned with respect to the supporting and guiding plate, which supporting and guiding plate rests against the outwardly curved (or flared) flange of the front part of the frame. Namely, the sealing plate is so dimensioned with respect to the face of the supporting and guiding plate which is directed toward it, that after the two frame parts are fastened together the edge region of the sealing plate which faces away from the supporting and guiding plate is held in compression against a supporting edge region of the rear frame part, so as to furnish a trouble-free seal. And furthermore, the bores passing through the sealing plate are configured to have ring-shaped grooves with supporting shoulders for engaging ring-shaped collars on the contact elements which collars project radially outwardly and are provided to fix the position of the contact elements when the contact elements are pushed into the connector assembly.

It has been found that a plug and socket connector according to the present invention ensures a trouble-free seal without the need to apply adhesives or sealing compounds during or after the mounting of the contact elements.

With the aim of providing a trouble-free seal while still allowing a certain movement of the contact elements after the contact elements have been mounted in the insulating body, it has proven advantageous if there are provided narrowed regions of smaller diameter in the bores in the sealing plate in the region of the openings of these bores into the corresponding bores in the front supporting and guiding plate. When the contact elements are pushed into the bores into which they are to be respectively installed, the rubberlike elastic material of the rear sealing plate is forced radially outward, as a result of which the contact elements are gripped and surrounded in a manner which provides a tight seal for a long service life. Nonetheless, even after the contact elements are installed they may be rotated to a certain extent around their longitudinal axis if required. It has proven advantageous for enhancing the seal if, according to a further refinement of the invention, in the sealing plate at a distance from each bore containing a contact element, a ring-shaped slot is provided which extends concentrically to the corresponding bore, with a matching ring-shaped axial projection on the supporting and guiding plate extending into and engaging the ring-shaped slot.

BRIEF DESCRIPTION OF THE DRAWINGS

Additional details, advantages, and features of the invention will be apparent from the following description taken together with the drawings, in which.

DETAILED DESCRIPTION OF THE INVENTION

Figure 2:
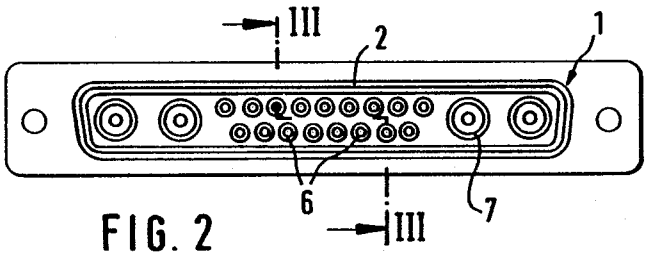
FIG. 2 is a plan view of the connector of FIG. 1.

As may be seen from the drawings, the plug and socket connector illustrated is comprised of an elongated connector frame (i.e., shell) 1 with a front part (i.e., front shell) 2 and a rear part (i.e., rear shell) 3. FIG. 2 illustrates the known "D-sub" type configuration of the connector. A two-piece insulating body is disposed between the two frame parts 2 and 3, which insulating body is comprised of a front piece 4 for supporting and guiding, fabricated of, e.g., thermoplastic plastic, and a rear piece 5 for sealing, fabricated of a rubberlike elastic plastic e.g. an isomer, for example polyisoprene or neoprene.

Both of the pieces 4, 5 of the insulating body are provided with a plurality of bores therein to accommodate a corresponding number of contact elements in the form of plug pins (not illustrated), plug sockets 6, or coaxial contacts 7 or analogously constructed concentric high-current contacts (not illustrated). The contact elements, including the plug sockets 6, are each provided with a plurality of contact springs which ensure low contact resistance.

Figure 1:
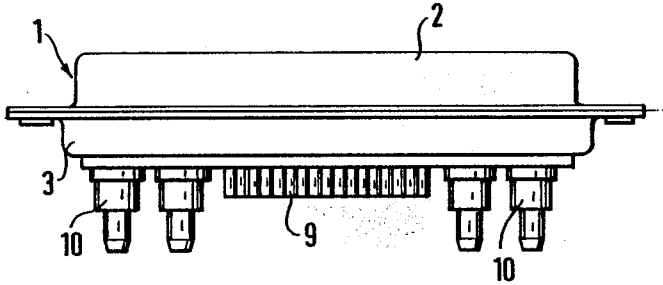
FIG. 1 is a lateral view of a plug and socket connector according to the invention.

The contact elements can be connected to a connecting cable at the rear of the connector, in known fashion. The bond may be by soldering, namely in the region of a soldering cup 8, or by a crimping technique in region 9, or at the rear of the coaxial contact elements by customary coaxial connecting pieces. FIGS. 1 and 2 show an example of a customary fitting 10.

Figure 3:
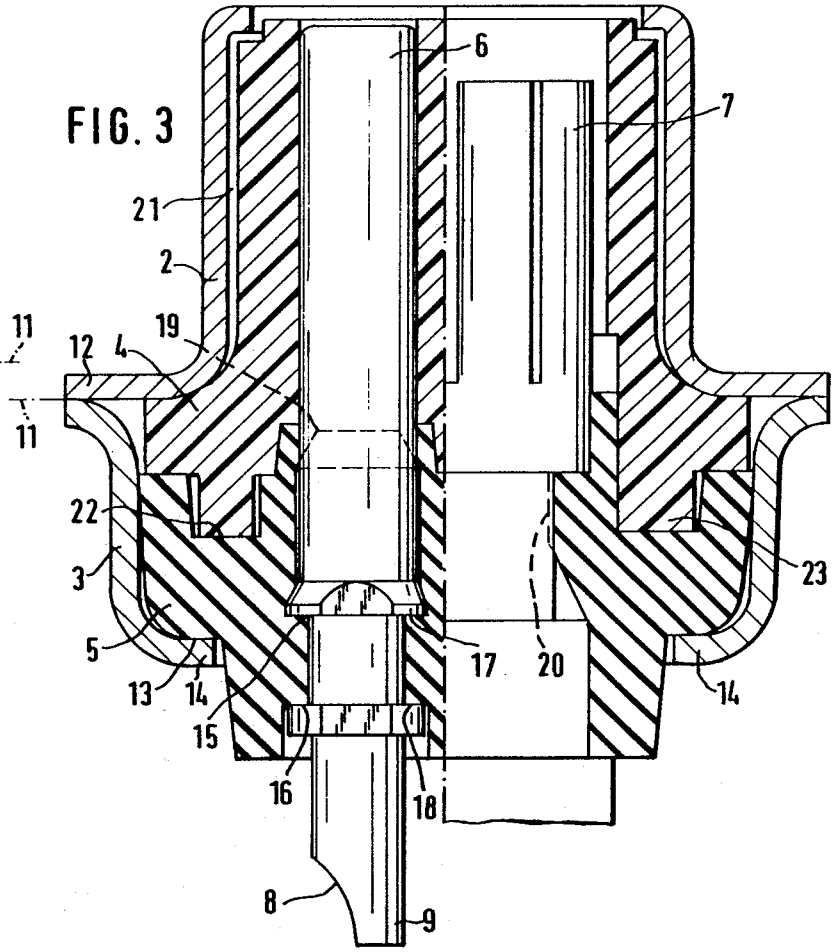
FIG. 3 is a cross section through the connector, taken along line 111—111 in FIG. 1.

FIG. 3 shows how the insulating body front piece (i.e, supporting and guiding plate) 4 rests against an outwardly flared flange 12 on the front part 2 of the frame near the common plane of separation 11 of the two frame parts 2, 3. The insulating body rear piece (i.e., sealing plate) 5 is so dimensioned with respect to the face of the front frame part 2 which faces it, that its edge region 13, which faces away from the plate 4 when the two frame parts 2, 3 are fastened together in the region of their common plane of separation 11, rests against the inwardly extending supporting edge region 14 of the rear frame part 3. Consequently the sealing plate 5 is placed under a precompression which ensures trouble-free sealing even over a long service time.

Also shown in FIG. 3 are two ring-shaped collars 15, 16 extending radially outwardly from the contact elements 6, which collars 15, 16 serve to fix the position of the contact elements 6 in the corresponding bores in the sealing plate 5. After the contact elements 6, 7 are pushed into the bores, the collars 15, 16 come to rest against supporting shoulders 17, 18 provided via ring-shaped grooves in the surfaces defining the bores.

As indicated with broken lines in FIG. 3, there are narrowed regions 19, 20 of smaller diameter in the bores in the sealing plate 5 in the region of the openings of these bores into the corresponding bores in the front plate 4. When the contact elements 6, 7 are pushed in, these narrowed bore regions 19, 20 of the sealing plate 5 are forcibly expanded radially outward, resulting in the contact elements 6, 7 being tightly gripped and surrounded. As shown, there is a slight play (i.e., clearance) 21 between the front frame part 2 and the outer face of the supporting and guiding plate 4, which allows for adjustment to dimensional differences during the process of engagement in plugging-in of a multipole plug having mating contact elements which mate to the socket elements shown. Despite a certain small movement allowed by this play, a secure seal results. Contributing to the secure seal is the gripping and surrounding action mentioned above which is provided by the configurations of regions 19, 20 by which the bores are narrowed. In order to assure strong contact over a relatively large area of the contact elements 6, 7, a ring-shaped slot 22 is provided in the sealing plate 5 at a distance from each bore and extending concentrically to the bore. A matching axial projection 23 on the supporting and guiding plate 4 extends into and engages the ring-shaped slot 22. The practically non-complaint thermoplastic material of the plate 4 supports the rubberlike elastic material in a ring-shaped region around the region of the bore which is near the opening where the bore in plate 5 opens into the bore in plate 4.

In the embodiment with plug pins instead of plug sockets as the contact elements (which embodiment is not illustrated), the axially parallel projections 23 on the supporting and guiding plate are of course unnecessary, because at that corresponding location the pins extend free in the direction toward the plane determined by the upper edge of the front frame part. The upper limiting plane of the supporting and guiding plate in this case ends approximately in the region of the common plane of separation 11 of the two frame parts 2, 3.

What is claimed:

1. An electrical plug and socket connector, comprising:

an elongated metal connector frame (1) adapted to be affixed to an apparatus housing or the like, the connector frame including a frame front part (2) and a frame rear part (3);

a two-piece insulating body (4, 5) fabricated of insulating materials and enclosed between the frame front and rear parts, said insulating body having a plurality of bores therein for accommodating a plurality of contact elements (6, 7) in the form of plug pins, plug sockets, or the like which elements become enclosed in and insulated by the insulating materials of the said insulating body, said contact elements (6, 7) being connectable to electrical conductors at a rear side of the connector, and at a front side of the connector said contact elements (6, 7) being engagable with mating contact elements of a corresponding multiconductor socket, plug or like member which are connected to a connecting cable, wherein the insulating body includes a front supporting and guiding plate (4) fabricated of thermoplastic plastic and having bores therein to accommodate frontward regions of the contact elements (6, 7), and a rear plate (5) with corresponding bores for rearward regions of the contact elements;

the rear plate of the insulating body being in the form of a sealing plate (5) of rubberlike elastic material, said sealing plate (5) being so dimensioned with respect to the face of said supporting and guiding plate (4) which face is directed toward it, and which supporting and guiding plate rests against an outwardly curved flange (12) of the front part of the frame, that after the two frame parts (2, 3) are fastened together an edge region (13) of said sealing plate which faces away from the supporting and guiding plate (4) is held in compression against a supporting edge region (14) of the rear frame part (3), so as to furnish a seal therewith;

and wherein the bores passing through the sealing plate (5) are configured to have therein ring-shaped grooves with supporting-shoulders (17, 18) for engaging ring-shaped collars (15, 16) on the contact elements which collars project radially outward and fix the position of the contact elements (6, 7) when said contact elements are pushed into the connector assembly.

2. An electrical plug and socket connector according to claim 1, wherein there are provided narrowed regions (19) of smaller diameter in the bores in the sealing plate (5) in the region of the openings of said bores into the corresponding bores in the front supporting and guiding plate (4).

3. An electrical plug and socket connector according to claim 1, wherein, in the sealing plate (5), at a distance from each bore containing a contact element (6, 7), a ring-shaped slot (22) is provided which extends concentrically to said bore, with a matching ring-shaped axial projection (23) on the supporting and guiding plate (4) extending into and engaging the said ring-shaped slot (22).

* * * * *